United States Patent [19]

Feibelman

[11] 4,099,611

[45] Jul. 11, 1978

[54] JEWELRY DISPLAY DEVICE

[75] Inventor: Jeffrey A. Feibelman, Cranston, R.I.

[73] Assignee: A. & H. Mfg. Co., Cranston, R.I.

[21] Appl. No.: 742,530

[22] Filed: Nov. 8, 1976

[51] Int. Cl.[2] ..... B65D 85/56; B65D 85/58

[52] U.S. Cl. ..... 206/45.14; 206/464; 206/487; 206/490; 206/562; 206/566

[58] Field of Search ..... 206/464, 465, 477, 482, 206/480, 487, 490, 560, 562, 566, 563, 44.11, 45.14, 564; 220/241, 242, DIG. 19

[56] References Cited

U.S. PATENT DOCUMENTS

| | | | |
|---|---|---|---|
| 182,604 | 9/1876 | Righter | 206/487 |
| 1,539,405 | 5/1925 | Ormsbee | 206/487 |
| 1,578,573 | 3/1926 | Ballow, Jr. | 206/477 |
| 1,879,041 | 9/1932 | Bender | 206/487 |
| 2,058,542 | 10/1936 | Wise | 206/482 |
| 2,324,310 | 7/1943 | McGovern | 206/482 |
| 3,125,221 | 3/1964 | Ax | 206/566 |
| 3,438,536 | 4/1969 | Tarchalski | 220/242 |
| 3,923,195 | 12/1975 | Wallace | 220/309 |

FOREIGN PATENT DOCUMENTS

| | | | |
|---|---|---|---|
| 51,656 | 4/1890 | Fed. Rep. of Germany | 206/477 |

*Primary Examiner*—William Price
*Assistant Examiner*—Joseph Man- Fu Moy
*Attorney, Agent, or Firm*—Salter & Michaelson

[57] ABSTRACT

A display device for use in the display of ornamental articles such as jewelry, comprising the combination of a plurality of display inserts and a support for releasably mounting such inserts within recesses formed in the front surface of such support. Each insert is provided with a pair of outwardly rearwardly extending ribs for engagement with relatively straight side edges formed by the terminal portions of webs inwardly extending from the recesses and in turn defining openings therein, the openings particularly adapted to receive rearwardly projecting portions of the articles of jewelry mounted on the inserts.

11 Claims, 6 Drawing Figures

JEWELRY DISPLAY DEVICE

BACKGROUND OF THE INVENTION

It is desirable to display jewelry articles such as earrings and the like on cards or other elements which in turn are mounted in groups upon a display rack or similar device. When displayed in this fashion, the articles can be simultaneously viewed by perspective purchasers and the individual cards or elements to which each piece of jewelry is attached may be removed by the salesperson to enable the prospective purchaser to more closely examine the articles. Such displays include counter racks having bars or rods supported therefrom from which article display cards may be releasably attached.

Unfortunately, a recurrent problem associated with such type jewelry devices is the theft of the cards holding the jewelry articles from their releasably secured position on the bars, collars, rods, etc., inasmuch as the display is often placed in areas that are not closely supervised by sales personnel. It would accordingly be desirable to provide a device of the general type under consideration wherein the device would not only include means for easily removing the cards or inserts upon which the jewelry articles are mounted, but which to the casual observer would appear to be more securely attached to the overall display and accordingly appear more difficult to remove than is actually the case. It is believed that such a device could well eliminate or at least substantially reduce such pilferage.

SUMMARY OF THE INVENTION

The present invention provides a particular display device which exhibits a unique interrelationship between the fixed and removable portions thereof so that to a casual observer the removable portions, that is, the inserts on which the jewelry articles are mounted, appear to form an integral part of the display and accordingly would lead the casual observer to believe that the inserts were either difficult to remove or nonremovable.

It is accordingly a principle object of the present invention to provide such a device wherein a plurality of display inserts, each adapted to receive an article to be displayed, are releasably mounted to a support within a plurality of recesses formed in the outer portions thereof wherein the means for securing such inserts within the display panel is hidden from view and not readily determinable by the casual observer.

Another object of the invention is the provision of a display device of the above-indicated type wherein each of the releasably supported display inserts thereof includes a pair of spaced, generally parallel ribs outwardy extending from the rear face thereof and adapted for cooperating frictional engagement with the relatively straight terminal edge portions of a pair of oppositely disposed webs inwardly extending from peripheral portions of the recesses.

A still further object of the present invention is the display device of the immediately preceeding aforementioned type wherein the releasable inserts are formed of a thin flexible plastic material which may be inwardly bent so that the securing means on the rear portions thereof in the form of spaced ribs may be more closely positioned in a bent position so as to better enable such to pass through openings provided within each of such recesses.

Other objects, features, and advantages of the invention will become apparent as the description thereof proceeds when considered in connection with the accompanying illustrative drawing.

DESCRIPTION OF THE DRAWING

In the drawings which illustrate the preferred embodiment presently contemplated for carrying out the present invention.

DESCRIPTION OF THE INVENTION

Figure 1:
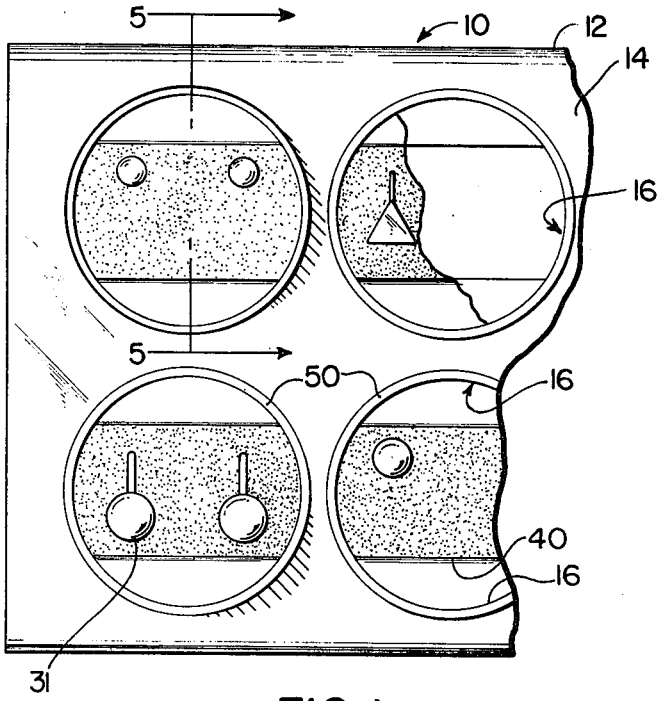
FIG. 1 is a fragmentary front elevational view showing one form of the present invention.

Referring now to the drawing, and more particular to FIG. 1 thereof, a display device 10 is shown as comprising a support 12 having a panel portion 14 thereof in which a plurality of recesses 16 are arranged in any suitable fashion; the two parallel rows illustrated forming one such configuration. The support 12 may also include some appropriate means for enabling it to be placed in a display mode as through suspension from a rack or similar device i.e., by means of the rearwardly extending arm 18. It should be pointed out, however, that the particular manner in which the support is held or otherwise mounted for display purposes forms no part of the present invention and the rearwardly extending arm 18 which would be conveniently adapted for suspension from horizontal rod means or the like as well as the particular distribution or number of recesses are given by reason of example only and not by way of intended limitation.

As will be apparent by overall reference to the drawing, each of the recesses 16 is adapted to receive an insert 20 in a manner that will be more apparent as the description of the invention proceeds. Generally, the configuration of the insert 20 and that of the recesses 16 is coordinated so that the peripheral extent of each recess 16 is of approximately the same shape and slightly larger in extent so as to conveniently receive the insert 20 in such a manner that they appear to form a part or continuing portion of the panel 14 of the support 12. Each recess 16 further includes a pair of oppositely disposed inwardly extending web portions 22 which cooperatively form a seat 23 for a respective insert 20, each terminates in a relatively straight edge 24 which in turn by reason of their spaced opposition to each other form an opening 26 which extends completely through the panel 14.

Figure 2:
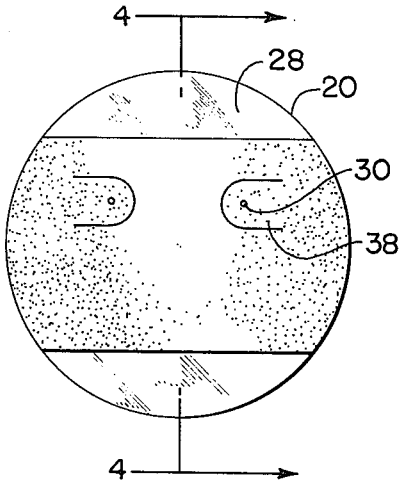
FIG. 2 is a front elevational view of one of the inserts per se.
Figure 3:
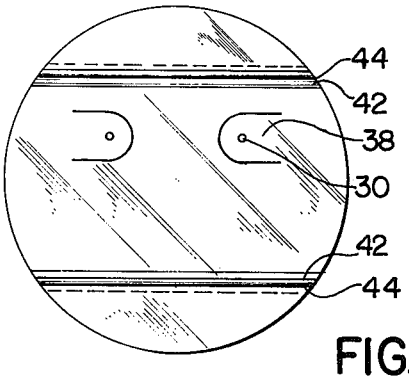
FIG. 3 is a rear elevational view of the insert shown in FIG. 2.
Figure 4:
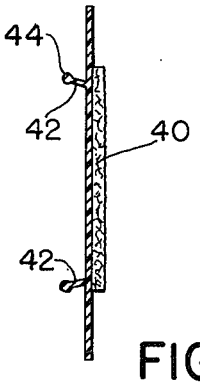
FIG. 4 is a side sectional view of the insert shown in FIGS. 2 and 3 taken along the line 4—4 of FIG. 2.

The article holder or insert 20 includes a generally flat body portion 28 preferably formed of thin and flexible plastic sheet material for a purpose which will be described hereinafter. The insert may be of various sizes and includes a variety of article holding or supporting slots, openings, tabs, perforations, and the like such as openings 30, specifically adapted to receive the shaft portion 32 of an ornamental article such as an earring 31 therein. Such openings 30 may be formed directly through the body 28 or within partially cut out tab or ear portions 38 in generally longitudinal spaced opposition to each other, as best depicted in FIGS. 2 and 3. The tabs are thus outwardly swingable and accordingly particularly adapted to support hoop-type earrings. In addition to the shaft 32, the earrings 31 include an ornament 34 and a keeping element or clutch 36, as is known in the art. Such attachment to the article holder or insert 20 enables the earrings to be removed from the back thereof as when the insert is removed from the holder 12. The front face of the insert 20 is further provided with a band of decorative cushioning material 40 such as flocking directly applied to the surface thereof or connected thereto as by adhesives. The bank or pad of decorative material 40 ornamentally sets off the jewelry articles as well as providing a supporting and protective pad for the decorative portion 34 thereof.

Figure 5:
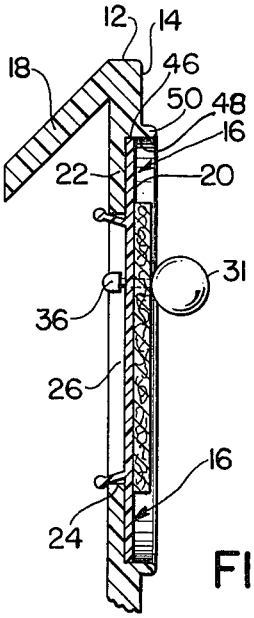
FIG. 5 is a partial side sectional view on an enlarged scale taken along the line 5—5 of FIG. 1 and shows an insert releasably secured within a recess formed in the front portion of the support panel.

Turning now to FIGS. 3 through 6 of the drawing, the means by which the inserts 20 may be releasably secured to the support 12 is best depicted. Such means includes a pair of outwardly rearwardly extending ribs 42 in spaced generally parallel opposition to each other orientated in such a manner so as to be frictionally engaged by the opposed relatively straight terminal edges 24 of the webs 22. Each of the ribs 42 also includes relatively thickened head portion 44 so as to better frictionally interengage with the edges 24, as best shown in FIG. 5. Such inserts are generally formed by the extrusion of plastic material such as the polystyrenes, acrylics, acetates, etc. directly into sheets at least the width of the inserts desired and of the cross-sectional configuration depicted, i.e., including the ribs 42 as an integral portion thereof, and then blanking out the inserts in the desired peripheral form from such sheets.

Figure 6:
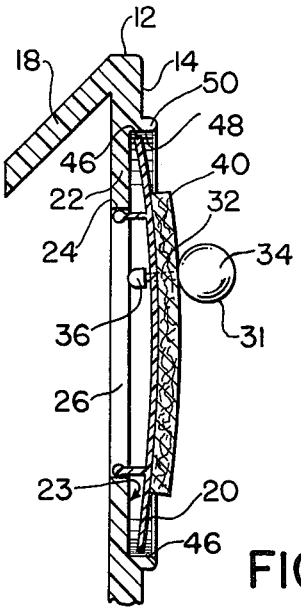
FIG. 6 is a cross-sectional view similar to FIG. 5 but showing the insert slightly inwardly bent so that the ribs thereof are more closely positioned to each other and more clearly showing the attitude which the insert assumes when either mounting or demounting same with respect to the display panel.

As is apparent from a simultaneous consideration of FIGS. 5 and 6, the laterial i.e., vertical extent between the ribs 42 is slightly less than that between the edges 24 defining the opening 26 at that point where the ribs connect with the rear face of the insert 20 and equal or slightly larger than such extent at that point where the ribs become enlarged at the terminal heads 44. Such relationship assures that a tight frictional engagement of the rib or at least the headed portion 44 thereof occurs between the insert 20 and the panel 14. Also, as best shown by FIG. 6 of the drawing, the insert 20 is inwardly flexible or bendable so that such action will enable the ribs to be more closely spaced to each other and accordingly enable them to pass through the opening 26 with greater ease; such action being desired either when the insert 20 is to be secured or removed from the panel 14. It should also be pointed out that the openings 30 are positioned within the body portion 28 of the insert between the ribs 42 so that rearwardly extending portions of the jewelry such as the shoot 32 will extend through the opening 26 and accordingly not otherwise interfere with the positioning or removal of the insert therefrom. In this manner then each insert 20 may be releasably secured within a respective recess 16 within the panel 14.

Such positioning is best depicted in FIG. 5 of the drawing wherein peripheral edge portions 46 of the insert 20 are snugly engaged within the peripheral shoulders 48 defining the recess 16. The lateral extent of the pad or support 40 is also preferably greater than that of the ribs 42 in their most spaced apart position as shown in FIG. 5 so that when the insert is formed of translucent or transparent material the attachment mechanism to the panel 14 is masked thereby, thus in this manner making it even more difficult for the casual observer to determine the manner of removing the article holding inserts 20 from the support. Additionally, each recess 16 may be surrounded by an upstanding boss or rib 50 making it more difficult to grasp the body portions 28 of the insert 28 from the front face of the support 12 and in this manner enhancing the pilferage features of the present device. Generally the support 12 and the inserts 20 are formed of similar materials and of the same color so as to better blend together so as to enhance an integral appearance; however, various colors and materials could be chosen to achieve differing design effects.

It should be also recognized that the orientation of the webs 22 which cooperatively form the seat 23 upon which the releasable insert 20 is adapted to rest can be other than the horizontal or longitudinal mode depicted, that is, such could be orientated so that the terminal edges 24 thereof are vertically orientated with respect to each other, the primary feature being that the edges 24 are relatively generally straight and generally parallel to each other so as to accommodate the presently known techniques of forming the rearwardly extending ribs of the insert 20 as by extrusion thereof.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A display device for use in the display of jewelry articles and the like comprising, in combination, a display insert adapted to receive an article to be displayed and a support for releasably mounting said display insert, said support including a substantially planar panel, said panel being provided with an opening, said opening delineated in part by a pair of panel webs terminating in relatively straight edges in opposed spaced relationship to each other, said webs forming a seat for receipt of said insert, said insert having a front face including means for receiving said articles and a rear face including a pair of spaced generally parallel longitudinally oriented ribs outwardy rearwardly extending therefrom, said insert adapted for receipt within said opening and having portions transversely extending beyond said ribs for face to face contact with said seat, each of said ribs contacting a respective web edge to releasably secure said insert over said opening, said device further including a recess formed within the front surface of said panel wherein said opening is formed within said recess, said recess having a perimetrical configuration and extent corresponding to but slightly larger than that of said display insert and wherein the outer extent of said insert substantially contacts the periphery of said recess, said webs in opposed parallel relationship and inwardly extending from the periphery of said recess, said insert being releasably secured within said recess, and wherein the terminal portions of said ribs extend rearwardly past said web edges.

2. The display device of claim 1, the respective rib terminal portions spaced apart a greater distance than said respective web edges wherein said insert is frictionally held within said recess.

3. The display device of claim 2, said ribs being outwardly flared, said rib terminal portions being positioned inwardly of said respective edges and behind said web.

4. The display device of claim 3, said insert being inwardly flexible about an axis longitudinally disposed between said ribs and generally parallel thereto.

5. The display device of claim 1, wherein the thickness of said panel surrounding said recess is greater than the thickness of the respective web portions thereof so that said insert is generally coplanar with the front surface of said panel.

6. The display device of claim 5, said recess having a peripheral rib upwardly extending from the front surface of said panel portion, said insert positioned beneath said peripheral rib.

7. The display device of claim 6, wherein the terminal portions of each of said ribs includes a thickened headed element for undercut engagement with said web edges.

8. The display device of claim 1, said attachment means including at least one opening through said insert for receipt of said article, said insert opening positioned between said pair of ribs.

9. The display device of claim 7, the front face of said insert having a decorative surface generally coextensive with that portion of the insert between said ribs thereof, said decorative surface including a pair of partially cut out longitudinally orientated ears, each ear having an opening therein for receipt of the shaft of an earring or similar ornamental article.

10. The display device of claim 1, comprising a plurality of said display inserts and a corresponding plurality of openings in said planar panel.

11. The display device of claim 1, there being a plurality of individual openings formed in said panel.

* * * * *